United States Patent [19]

Santén

[11] Patent Number: 4,497,609

[45] Date of Patent: Feb. 5, 1985

[54] METHOD AND DEVICE FOR CONTINUOUS SUPPLY OF LUMPS OF MATERIAL TO A SHAFT

[75] Inventor: Sven O. Santén, Hofors, Sweden

[73] Assignee: SKF Steel Engineering Aktiebolag, Hofors, Sweden

[21] Appl. No.: 327,936

[22] Filed: Dec. 7, 1981

[30] Foreign Application Priority Data

Mar. 10, 1981 [SE] Sweden ..... 8101494

[51] Int. Cl.[3] ..... F27B 1/20

[52] U.S. Cl. ..... 414/786; 414/160; 414/162; 266/44; 266/176; 266/184

[58] Field of Search ..... 414/160, 162, 199, 200, 414/201, 202, 203, 204, 205, 206, 208, 786; 266/44, 176, 184

[56] References Cited

U.S. PATENT DOCUMENTS

| | | | |
|---|---|---|---|
| 1,348,525 | 8/1920 | Ward | 432/5 |
| 2,022,112 | 11/1935 | Ferguson | 414/160 X |
| 2,083,711 | 6/1937 | Huyck | 414/199 X |
| 3,071,357 | 1/1963 | Blaha | 432/100 |
| 3,633,897 | 1/1972 | Vogel | 414/204 X |
| 3,648,997 | 3/1972 | Kanokogi | 414/202 X |
| 4,196,893 | 4/1980 | Otsuki et al. | 266/176 X |

FOREIGN PATENT DOCUMENTS

| | | | |
|---|---|---|---|
| 801015 | 7/1949 | Fed. Rep. of Germany . | |
| 1508503 | 3/1970 | Fed. Rep. of Germany . | |
| 1367391 | 6/1964 | France | 414/199 |
| 335745 | 2/1969 | Sweden . | |
| 140026 | 3/1979 | Sweden . | |
| 415797 | 10/1980 | Sweden . | |

*Primary Examiner*—Robert J. Spar
*Assistant Examiner*—Ken Muncy
*Attorney, Agent, or Firm*—Brumbaugh, Graves, Donohue & Raymond

[57] ABSTRACT

A method and a device is provided for continuously supplying from above piece-shaped, i.e. lumps of, material to a shaft through which a high-temperature gas is conducted from below upwardly to a centrally disposed upper gas outlet. The piece-shaped material at the upper end is fed into the shaft at the top via evenly distributed and closed feed tubes or via an annular feed gap adjacent the periphery of the shaft.

6 Claims, 2 Drawing Figures

Figures 1, 2:
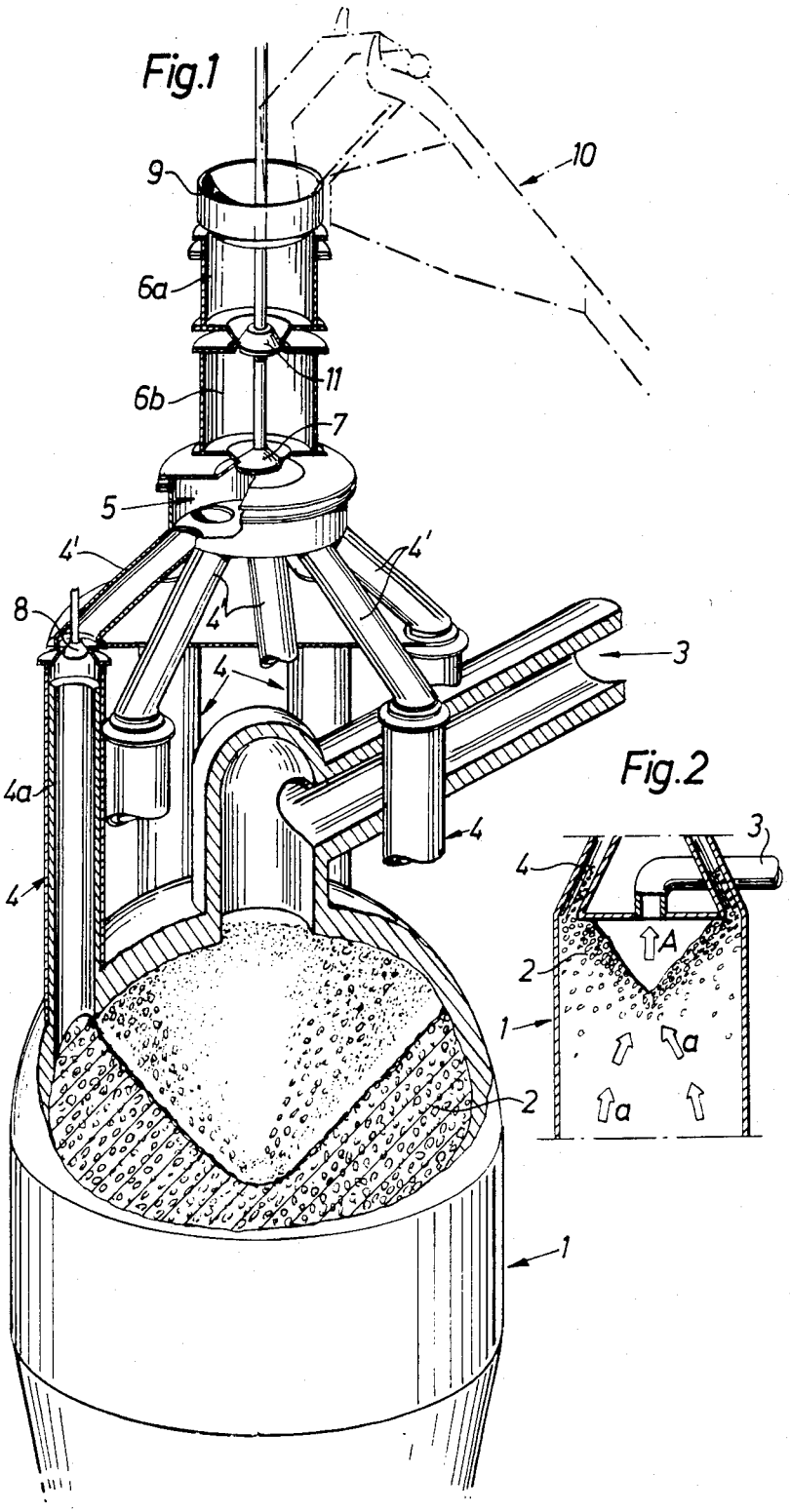

9
10
6a
11
6b
7
5
4'
4'
8
4'
3
4
4a
4
4
2
1

3
4
A
2
1
a
a

METHOD AND DEVICE FOR CONTINUOUS SUPPLY OF LUMPS OF MATERIAL TO A SHAFT

DESCRIPTION

The present invention relates to a method and a device for continuous supply of preferably carbonaceous piece-shaped, i.e. lumps or particles of, material to a shaft through which gas at a high temperature is conducted to a centrally disposed upper gas outlet.

The method and the device according to the present invention are adapted to enable gas at high temperature to flow through a shaft, for example a shaft furnace, in which slick is reduced. By this means, an outlet gas temperature of an order or magnitude of up to 1100° C. is obtained. This high outlet gas temperature would exert a considerable action on the furnace lining if directly exposed to gases at such high temperatures. By filling the shaft with lumps of carbonaceous material, the shaft lining is protected against the direct action of the high outlet gas temperatures while at the same time the direct radiation heat from the reaction zone, which for example may be brought about by means of a plasma generator, are prevented from reaching the limiting surfaces of the shaft.

It is desirable to create conditions within a shaft that the gas flow therein will take place substantially centrally within the shaft to an upper gas outlet, so as to avoid to the greatest possible extent excessive heat strains on the shaft lining and the feed arrangements through which the lumps of carbonaceous piece-shaped material are fed into the shaft.

It is also desirable to bring about substantially constant gas flow conditions within the shaft permitting a combined cooling and regeneration of the exhaust gases enabling them to be used, for example, as reaction gas within the shaft.

The present invention provides a method of supplying from above lumps of material to a shaft through which a high-temperature gas is conducted from below upwardly to a centrally disposed upper gas outlet, in which the lumps of material are fed into the shaft via evenly distributed and closed feed tubes or via an annular feed gap adjacent to the periphery of the shaft.

The present invention also provides a device for carrying out the above process, the device comprising a shaft and, opening into the shaft adjacent to the periphery thereof, closed feed tubes or an annular feed gap opening into closed feed tubes or an annular feed gap.

By feeding the lumps of material into the upper end of the shaft via evenly distributed and closed feed pipes or via an annular feed gap, the limiting surface of the material in the upper part of the shaft will form a conical groove corresponding to the natural angle of repose, which means that the material layer will cover the inner limiting surface of the shaft with an upwardly diminishing thickness. The distribution so obtained at the upper part of the shaft promotes a central gas flow within the shaft and outwardly through a centrally disposed gas outlet while at the same time the heat stress on the feed pipes or the feed gap can be reduced to a great extent.

In order to facilitate the filling of lumps of material into the shaft, a distribution chamber is suitably provided ahead of the feed pipes or the annular feed gap, causing the material from the distribution chamber to be evenly distributed in a suitable way betweeen the pipes or over the whole feed gap. In order to reduce the risk of a flow of a gas through the feed pipes or the feed gap, there will be suitably provided at least one sluice chamber ahead of or behind the distributing chamber. In this case valve devices are provided between the distributing chamber and the sluice chamber, on the one hand, and the feed pipes and feed gap, on the other hand.

The invention will now be described with reference to the Figures of the accompanying Drawing in which:

FIG. 1 schematically shows a perspective view with certain parts broken away of a device for continuous supply of a piece-shaped, i.e. lumps or particles of, material to a shaft; and FIG. 2 schematically shows a section of the upper portion of the shaft and the device for supplying piece-shaped, i.e. lumps or particles of, material, illustrating the central gas flow in the shaft.

In FIG. 1 shaft 1 is provided with an upper gas outlet 3, the shaft being filled with piece-shaped material 2. This piece-shaped material 2 is supplied by means of closed feed pipes 4 evenly distributed around the upper periphery of shaft 1.

The suitably carbonaceous, piece-shaped material is supplied from above by means of a conveying device having the general reference designation 10 to a feed hopper 9 and a first chamber 6*a*. From there the material is fed via a valve device 11 to a sluice chamber 6*b* for further conveyance to the distributing chamber 5 via a valve device 7. From the distributing chamber 5 the material is automatically conveyed further to each branch tube 4' leading to one of the closed feed pipes 4. A valve device 8 is provided between each branch tube 4' and each closed feed tube 4.

The arrangement comprising the various valve devices 7, 8 and 11 eliminates any tendency towards gas flow through the feed tubes 4, the branch tubes 4', the distributing chamber 5 and the sluice chamber 6*b*. The gas flow that may occur during the short-time opening of the valve devices in connection with the the downward feed of the piece-shaped material towards the shaft and the temperature increase caused thereby in the feeding parts will be negligible, the temperature increase of the parts exposed to the gas flow being extremely moderate.

The piece-shaped material 2 can advantageously be permitted to collect in the closed feed tubes 4 and thereby contributes towards a screening of the valve devices 8 against the high temperatures prevailing within shaft 1. By providing the inner surfaces of the closed feed tubes 4 with a lining of refractory material 4*a*, heat conducted by contact-transmission within the piece-shaped material will be prevented from damaging the feed tubes 4. Piece-shaped material 2 within the feed tubes 4 will also protect the valve devices 8 against direct heat radiation from the interior of shaft 1.

By means of arrows a and A, FIG. 2 shows how the central gas flow is performed within shaft 1 towards the gas outlet 3.

I claim:

1. A method of withdrawing high temperature gas at a central upper portion of a shaft such that said high temperature gas is directed away from the upper periphery of the shaft and toward said central upper portion, said method comprising the steps of:

(a) providing supply means for supplying lump material to the shaft, said supply means having discharge means for discharging said material into said shaft substantially completely around and adjacent to the upper periphery of the shaft;

(b) feeding said material through said supply means into said shaft such that the shaft is continuously filled with said material substantially at least to the height of said discharge means thereby causing the upper surface of said material in said shaft to form an inverted cone extending downwardly from the periphery of the shaft to the center of the shaft such that the surface of the cone has a downward angle which substantially corresponds to the natural angle of repose of said material;

(c) passing high temperature gas upwardly through the shaft and through the material such that as the gas reaches the region of the inverted cone-shaped upper surface of the material it will tend to flow toward the central portion of the shaft, thereby reducing heat stresses from said high temperature gas on the inner surface of the shaft and the supply means;

(d) passing the high temperature gas upwardly through the inverted cone upper surface of the material and withdrawing said gas from the shaft through a centrally disposed gas outlet.

2. A method according to claim 1 wherein said supply means comprise feed tubes having discharge openings substantially evenly distributed around the upper periphery of the shaft.

3. A method according to claim 2 including the step of supplying material to the feed tubes by means of a distributing chamber to which each feed tube is connected.

4. A method according to claim 3 including the step of supplying material to the distributing chamber by means of at least one sluice chamber having a valve device for controlling the feeding of said material from said at least one sluice chamber to said distributing chamber.

5. A method according to claim 1 including the step of providing valve means in said supply means and opening said valve means only when material is being supplied to the shaft, thereby substantially preventing the flow of the high temperature gas in said supply means countercurrent to the flow of the material into the shaft.

6. A method according to claim 1 including the step of feeding carbonaceous material through said supply means into said shaft.

* * * * *